US012698610B2

(12) United States Patent
Masghouni et al.

(10) Patent No.: US 12,698,610 B2
(45) Date of Patent: Aug. 4, 2026

(54) COMPOSITE HELICAL ANCHORS AND PILES

(71) Applicant: Hubbell Incorporated, Shelton, CT (US)

(72) Inventors: Nejib Masghouni, Alpharetta, GA (US); Gary Leonard Seider, Centralia, MO (US)

(73) Assignee: Hubbell Incorporated, Shelton, CT (US)

( * ) Notice: Subject to any disclaimer, the term of this patent is extended or adjusted under 35 U.S.C. 154(b) by 253 days.

(21) Appl. No.: 18/489,402

(22) Filed: Oct. 18, 2023

(65) Prior Publication Data

US 2024/0125071 A1 Apr. 18, 2024

Related U.S. Application Data

(60) Provisional application No. 63/417,142, filed on Oct. 18, 2022.

(51) Int. Cl.

| | |
|---|---|
| ***E02D 5/56*** | (2006.01) |
| ***E02D 5/24*** | (2006.01) |
| ***E02D 5/54*** | (2006.01) |
| ***E02D 5/80*** | (2006.01) |

(52) U.S. Cl.

CPC ..... *E02D 5/56* (2013.01); *E02D 5/24* (2013.01); *E02D 5/54* (2013.01); *E02D 5/801* (2013.01)

(58) Field of Classification Search

CPC .... E02D 5/56; E02D 5/24; E02D 5/54; E02D 5/801

See application file for complete search history.

(56) References Cited

U.S. PATENT DOCUMENTS

| | | | | | |
|---|---|---|---|---|---|
| 1,883,477 | A | * | 10/1932 | Bash | E02D 5/801 52/157 |
| 4,316,350 | A | * | 2/1982 | Watson | E02D 5/801 52/157 |
| 4,334,392 | A | | 6/1982 | Dziedzic | |
| 5,113,626 | A | * | 5/1992 | Seider | E02D 5/801 175/395 |
| 5,265,982 | A | * | 11/1993 | Burtelson | E02D 5/801 52/157 |
| 5,286,142 | A | * | 2/1994 | Hoyt | E02D 5/801 52/157 |
| 5,295,766 | A | * | 3/1994 | Tiikkainen | E02D 31/14 52/157 |
| 5,408,788 | A | * | 4/1995 | Hamilton | E02D 5/801 405/253 |

(Continued)

FOREIGN PATENT DOCUMENTS

WO 2013067584 5/2013

OTHER PUBLICATIONS

International Preliminary Report on Patentability in corresponding International Application No. PCT/US2023/077163 mailed May 1, 2025. (7 pages).

(Continued)

*Primary Examiner* — Omar F Hijaz

(74) *Attorney, Agent, or Firm* — Wissing Miller LLP

(57) ABSTRACT

The present disclosure provides polymer composite helical anchors/piles comprising a polymer composite shaft and at least one polymer composite helical plate extending laterally from the polymer composite shaft.

8 Claims, 9 Drawing Sheets

(56) References Cited

U.S. PATENT DOCUMENTS

| | | | | |
|---|---|---|---|---|
| 5,607,261 | A * | 3/1997 | Odom | E02D 5/801 52/157 |
| 5,653,069 | A * | 8/1997 | Dziedzic | E02D 5/74 52/165 |
| 6,412,235 | B1 | 7/2002 | Pylant | |
| 10,508,406 | B1 * | 12/2019 | Childress | E02D 7/00 |
| 11,459,720 | B2 * | 10/2022 | Plotkin | E02D 5/56 |
| 2006/0051183 | A1 * | 3/2006 | Powell | E04H 12/2223 411/386 |
| 2014/0007487 | A1 | 1/2014 | Schwiebert | |
| 2023/0165613 | A1 * | 6/2023 | Miller | A61B 17/861 606/308 |

OTHER PUBLICATIONS

International Search Report and Written Opinion in corresponding International Application No. PCT/US23/77163 mailed Apr. 4, 2024. (13 pages).

* cited by examiner

COMPOSITE HELICAL ANCHORS AND PILES

CROSS-REFERENCE TO RELATED APPLICATIONS

This application claims priority to U.S. Provisional Application Ser. No. 63/417,142 filed Oct. 18, 2022 entitled COMPOSITE HELICAL ANCHORS AND PILES the contents of which are incorporated herein in their entirety by reference.

BACKGROUND

Field

The present disclosure relates generally to helical anchors and piles, and more particularly to composite helical anchors and piles.

Description of the Related Art

Anchors and piles are used to support structures, such as buildings, towers, power lines, retaining walls, guy wires, etc. when the soil underlying the structure would be too weak alone to support the structure. To effectively support a structure, an anchor or pile has to penetrate the soil to a depth where competent stratum is found that will resist tension (uplift) and/or compression (bearing) loads. Conventional anchors and piles can be cast in place by excavating a hole in the place where the anchor or pile is needed, or a hollow form can be driven into the ground where the anchor or pile is needed, and then filled with cement. These approaches are cumbersome and expensive.

Helical or screw anchors/piles are a cost-effective alternative to conventional cement piles and anchors because of the speed and ease at which a helical anchor/pile can be installed. Helical anchors/piles are extendable deep foundation systems having one or more helix plates welded to a central steel shaft or lead section. Load is transferred through the shaft to the soil through the helix plates. Helical anchors are installed such that the helical plate(s) at the tip of the anchor are deep enough into the soil to bear the uplift. Helical anchors are rotated under down pressure such that the tension resisting/load bearing helical plates at the lower end of the anchor/pile effectively screw the anchor/pile into the soil to a desired depth. Today, helical anchors/piles are used extensively by power utilities as guy anchors and tower foundations and are finding increased popularity in civil construction applications such as building foundations, tie-downs and retaining walls because of their versatility, ease of use and cost-effectiveness.

Generally, helical anchors/piles are made out of wrought steel plate and bar and their constituents are assembled via welding or mechanical fastening. Welding the helical plates to the central metal shaft or lead section is a time consuming and labor-intensive process requiring certified welders. In addition, when the shaft or lead section is made from a solid section of metal material, male and female unions may need to be welded to the ends of the metal shaft or lead section to allow them to be interconnected. When a hollow metal shaft or lead section is utilized, they must undergo additional processing to press or otherwise form the male and female unions in the ends of the hollow shaft or lead section. Existing anchors/piles are generally heavy and difficult to work with. In addition, because existing anchors/piles are formed from metal, they have a limited lifetime because of corrosion, and have poor thermal insulation properties.

A need exists for helical anchors/piles which avoid these and other problems associated with existing helical anchors/piles.

SUMMARY

The present disclosure provides polymer composite helical anchors/piles including a polymer composite shaft and at least one polymer composite helical plate attached to the shaft.

The present disclosure also provides helical anchors/piles including a polymer composite shaft having an end portion and a head portion, wherein the head portion is configured to connect to at least one of an extension and a thimble eyelet and at least one helical plate is attached at the end portion of the shaft.

BRIEF DESCRIPTION OF THE DRAWINGS

The figures depict embodiments for purposes of illustration only. It will be readily recognized from the following description that alternative embodiments of the structures illustrated herein may be employed without departing from the spirit and scope of the principles described herein, wherein.

DETAILED DESCRIPTION

The present disclosure relates to helical anchors, helical piles, leads and extensions and anchor rods. While the present disclosure may refer specifically to helical anchors, helical piles, helical anchors/piles, these phrases are not intended to be limited to helical anchors and/or helical piles but are also intended to encompass anchor rods, leads, shafts and extensions utilized with helical anchors and helical piles. Embodiments of the present disclosure encompass helical anchors, helical piles, leads, shafts and extensions and anchor rods made entirely or partially from polymer composite materials. The helical anchors/piles may be formed from polymer composite materials during one or more manufacturing processes and/or utilizing one or more polymer composite materials. The helical anchors/piles, anchor rods, leads, shafts and extensions may be formed as single units or may be formed from one or more components that are later attached. Portions of the helical anchors/piles may be formed from metal and/or metal/polymer composite materials. Different metal inserts may be added during the manufacturing process. The polymer composite materials may include one or more additives to provide additional strength, abrasion resistance, UV resistance etc. Reinforcing fibers which may be glass, carbon, basalt, aramid, etc. or combinations thereof may be utilized. The parts may be joined during the polymer composite material manufacturing process or joined by welding, mechanical fastening, etc.

Figure 1:
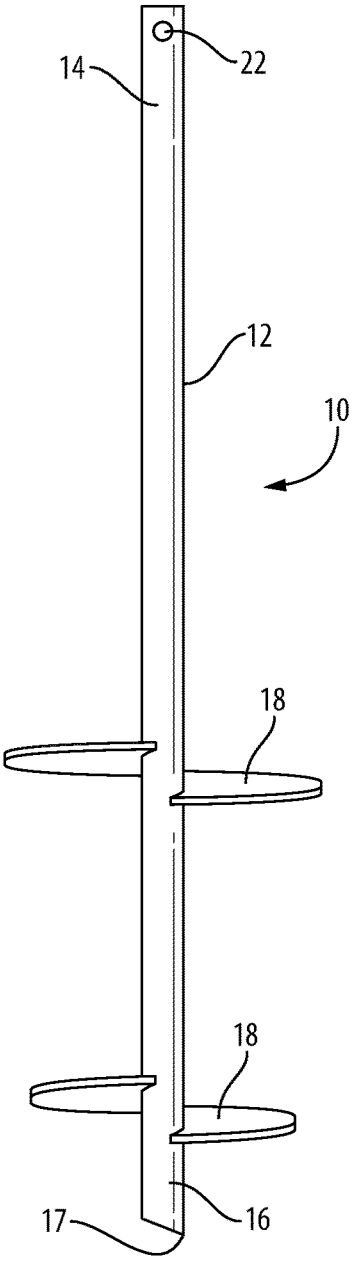
FIG. 1 is a side view of a helical anchor/pile according to an illustrative embodiment of the present disclosure.
Figure 3A:
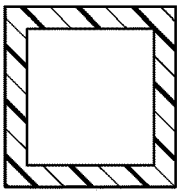
FIGS. 3A-3E are cross-sectional views of a helical anchor/pile shaft or lead according to various embodiments of the present disclosure.
Figure 3B:
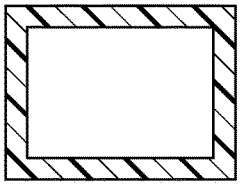
Figure 3C:
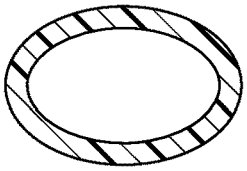
Figure 3D:
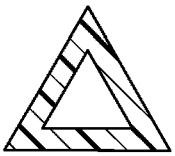
Figure 3E:
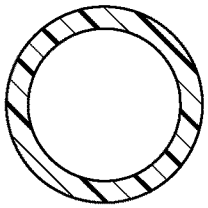
Figure 4:
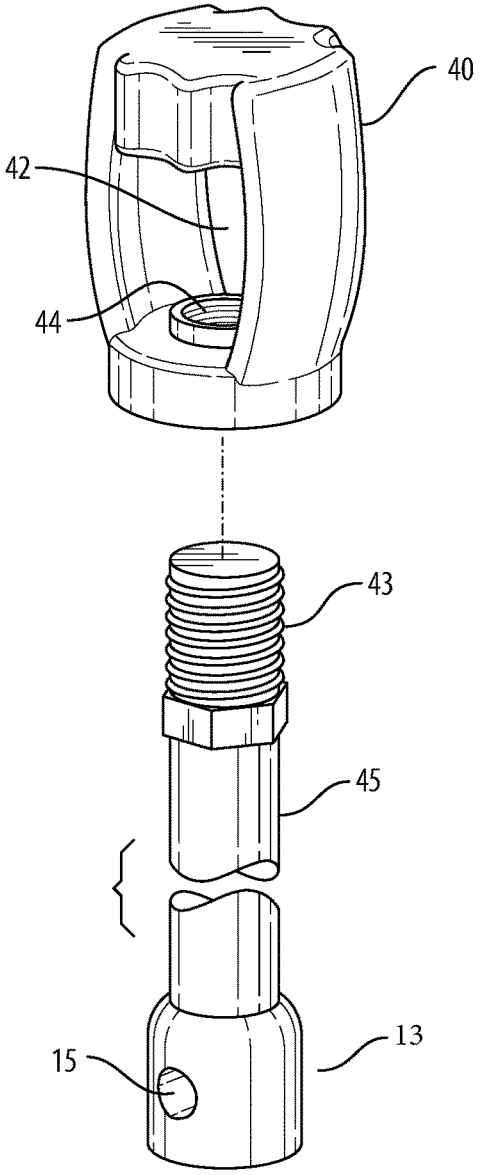
FIG. 4 is a side perspective view of a thimble eyelet according to an embodiment of the present disclosure.

A helical anchor/pile 10 according to an illustrative embodiment of the present disclosure is shown in FIG. 1. The helical anchor/pile 10 includes a lead 12, which has a lead head portion 14 and a lead end portion 16. Lead 12 may have any cross-sectional shape desired including, for example, square (FIG. 3A), rectangular (FIG. 3B), oblong (FIG. 3C), triangular (FIG. 3D), round (FIG. 3E), etc. and may be solid or hollow. The lead end portion 16 has a pointed tip 17 and is configured to first penetrate the soil. The length of the lead 12 may vary depending on a particular application and may be between about 3 feet and 10 feet and may be extended utilizing one or more extensions or leads. The length of the lead 12 may vary depending upon the load the anchor/pile 10 is to carry, the amount of uplift resistance required, the soil conditions into which the anchor/pile 10 is to be set and/or the type of equipment used for installation. The lead end portion 16 may have one or more spaced apart helical plate(s) 18 arranged on the lead 12 to penetrate the soil. The helical plate(s) 18 on the lead 12 may have the same diameter. Alternatively, the helical plates 18 may have different diameters that may be arranged in a tapered arrangement. For example, the tapered arrangement may be such that the smallest diameter helical plate is closest to the pointed tip 17 and a larger diameter helical plate is at a distance away from the pointed tip 17 or vice versa. Lead head portion 14 may have any type of connection suitable for a particular application. For example, according to the present embodiment, lead head portion 14 may have an orifice 22 extending laterally therethrough. Lead head portion 14 may be attached to an extension lead or as depicted in FIG. 4, an anchor rod 45 which has a female connecting end 13 having an orifice 15 which corresponds to an aligns with orifice 22 when lead head portion 14 is positioned in female connecting end 13. A pin or nut and bolt (not shown) may be passed through orifice 15 and orifice 22 and used to secure anchor rod 45 to lead head portion 14. Thimble eyelet 40 includes a transverse hole 42 through which guy wires may be connected and a female threaded hole 44 dimensioned for attaching to threaded end 43 of anchor rod 45.

According to the present illustrative embodiment, the helical anchor/pile 10, anchor pile 45 and/or thimble eyelet 40 may be made entirely from one or more polymer composite materials which are high in strength and stiffness, lightweight, and are easily processed. The polymer may be a thermosetting resin (Polyester, Vinyl ester, Epoxy, etc.) or Thermoplastic (PP, PE, PET, TPU, PA6, PA66, POM, PEEK, PAEK, PPS, etc. or combinations thereof). Reinforcing fibers which may be glass, carbon, basalt, aramid, etc. or combinations thereof may be utilized. The reinforcing fibers may be in the form of strands, chopped or an interwoven mat. The phrase polymer composite materials as used herein refers to one or more of the above-described polymers and may include one or more of the above-described reinforcing fibers and/or one or more additives to provide additional strength, abrasion resistance, ultra-violet (UV) light protection, etc. The manufacturing process for forming the helical anchor/pile may be resin transfer molding (RTM), sheet molded compound (SMC), bulk molding compound (BMC), injection molding, compression molding, etc. or combinations thereof and may include, for example, long fiber thermoplastic-direct (LFTD) compression molding and/or injection molding According to an embodiment of the present disclosure, the entire helical anchor/pile 10 depicted in FIG. 1 can be formed as one unit using one or more of the materials and manufacturing processes described above. As used herein, the phrase "manufacturing process" refers to one of more of the processes including resin transfer molding (RTM), sheet molded compound (SMC), bulk molding compound (BMC), injection molding, compression molding, etc. or combinations thereof including, for example, long fiber thermoplastic-direct (LFTD) compression molding and/or injection molding.

Figure 2A:
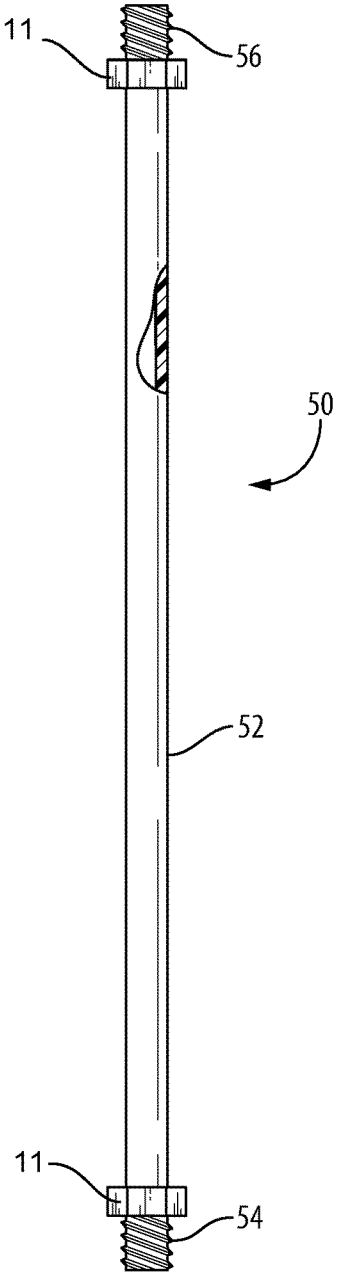
FIGS. 2A-2C are side views of a helical anchor/pile shaft or lead and various inserts according to illustrative embodiments of the present disclosure.
Figure 2B:
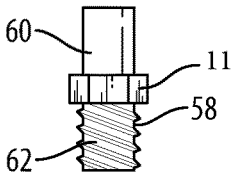
Figure 2C:
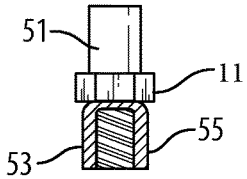

An anchor rod according to an illustrative embodiment of the present disclosure is depicted in FIG. 2A and is referred to herein as anchor rod 50. Anchor rod 50 includes a shaft or lead 52 having connecting ends 54, 56. Anchor rod 50 may be formed entirely from one or more polymer composite materials. Shaft or lead 52 may have any cross-sectional shape desired including, for example, square (FIG. 3A), rectangular (FIG. 3B), oval (FIG. 3C), triangular (FIG. 3D), round (FIG. 3E), etc. and may be solid, hollow and/or have a metal core encased in the polymer composite material. Although depicted as having male threads, one or both of connecting ends 54, 56 may be hollow forming a female receptacle with interior threads. One or more shaped wrench extensions 11 may be provided around the outer periphery of shaft or lead 52. The shaped extensions 11 may have any cross-sectional shape (e.g., square, octagonal, etc.) suitable for receiving a tool (e.g., a box wrench, pliers, etc.) that may be used to tighten connecting ends 54 and/or 56 to another anchor rod or other accessory or attachment. According to another embodiment of the present disclosure, connecting end(s) 54 and/or 56 may consist of metal threaded inserts incorporated into the polymer composite shaft or lead 52 during the manufacturing process. An example of a suitable metal threaded insert 58 is shown in FIG. 2B and consists of a metal tube or rod having a hollow first end 60 that attaches to shaft or lead 52 during the manufacturing process and a second end 62 having external male threads. Second end 62 may be solid or hollow as desired. Preferably, first end 60 has a cross-sectional shape other than round to provide a secure attachment to the polymer composite shaft or lead 52 and prevent rotation of the threaded insert 58 with respect to the polymer composite shaft or lead 52. According to another illustrative embodiment of the present disclosure a metal female threaded insert 55 is shown in FIG. 2C in partial cross-section and consists of a metal tube or rod having a hollow first end 51 that attaches to shaft or lead 52 during the manufacturing process and a hollow second end 53 having female interior threads. Preferably, first end 51 has a cross-sectional shape other than round to provide a secure attachment to the polymer composite shaft or lead 52 and prevent rotation of the threaded insert 55 with respect to the polymer composite shaft or lead 52. Threaded inserts 55 and 58 may also include shaped wrench extensions 11 around the outer periphery of the metal tube or rod.

Figure 2D:
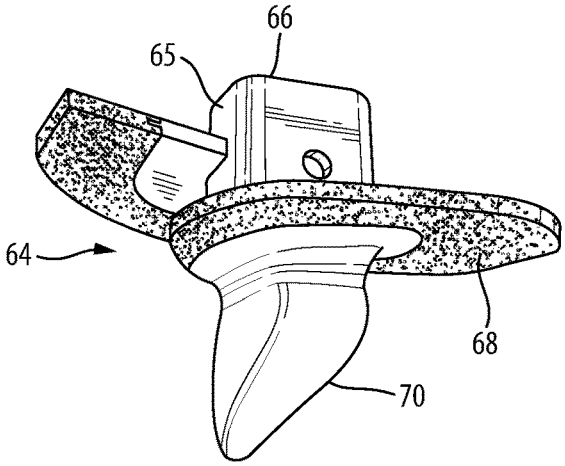
FIG. 2D-2H are views of portions of helical anchor/pile and shafts or leads according to illustrative embodiments of the present disclosure.
Figure 2E:
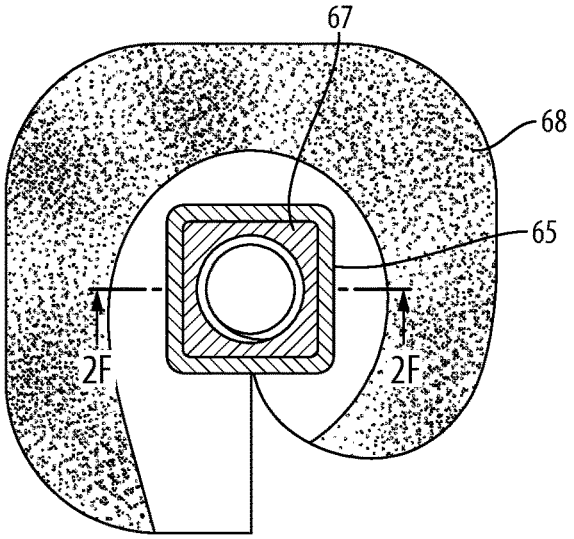
Figure 2F:
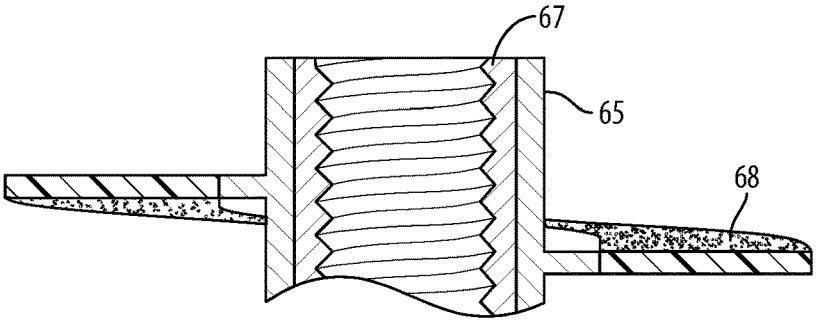

Various accessories may be attached to the threaded ends of shaft or lead 52. For example, the female threads 44 of a thimble eyelet 40 as shown in FIG. 4 may be attached to corresponding male threaded connecting end 56 of shaft or lead 52 (FIG. 2A) (or threaded end 62 of insert 58 (FIG. 2B)). In addition, according to other illustrative embodiments of the present disclosure, a helical anchor or tip 64, such as that shown in FIGS. 2D-2H, may be attached to a shaft or lead 52. Helical anchor or tip 64 includes a shaft 66 having a female threaded first end 65 dimensioned to receive and attach to threaded male connecting end 54 of shaft or lead 52 (or threaded end 62 of insert 58). Helical anchor or tip 64 has a pointed second end 70 which is configured to first penetrate the soil. Helical anchor or tip 64 may have one or more optional helical plates 68 that may be formed in situ with or welded to or otherwise attached to shaft 66 as shown, for example, in FIG. 2D. According to an illustrative embodiment, instead of having a threaded first end 65 for screwing onto shaft or lead 52, helical anchor or tip 64 may be a metal or metal/polymer composite insert with or without helical plates 68 and may be attached to shaft or lead 52 during the manufacturing process. For example, the helical anchor or tip 64 may be placed in an appropriate mold such that when the polymer composite material is introduced into the mold for forming shaft or lead 52, the shaft or lead 52 will conform and attach to the shaft 66 of the first end 65 of helical tip 64. Helical tip 64 may itself be formed entirely from one or more materials including polymer composite materials. Alternatively, helical anchor or tip 64 may be formed of polymer composite materials and/or partially from metal and/or may be covered by the polymer composite materials during the manufacturing process For example, according to an illustrative embodiment as shown in FIGS. 2D-2F, shaft 66, and portions of helical plate(s) 68 and pointed end 70 may be made of metal. As shown in FIG. 2F, first end 65 includes female threaded orifice 67. According to this embodiment, one or more portions of helical plate(s) may be made from polymer composite materials.

Figure 2G:
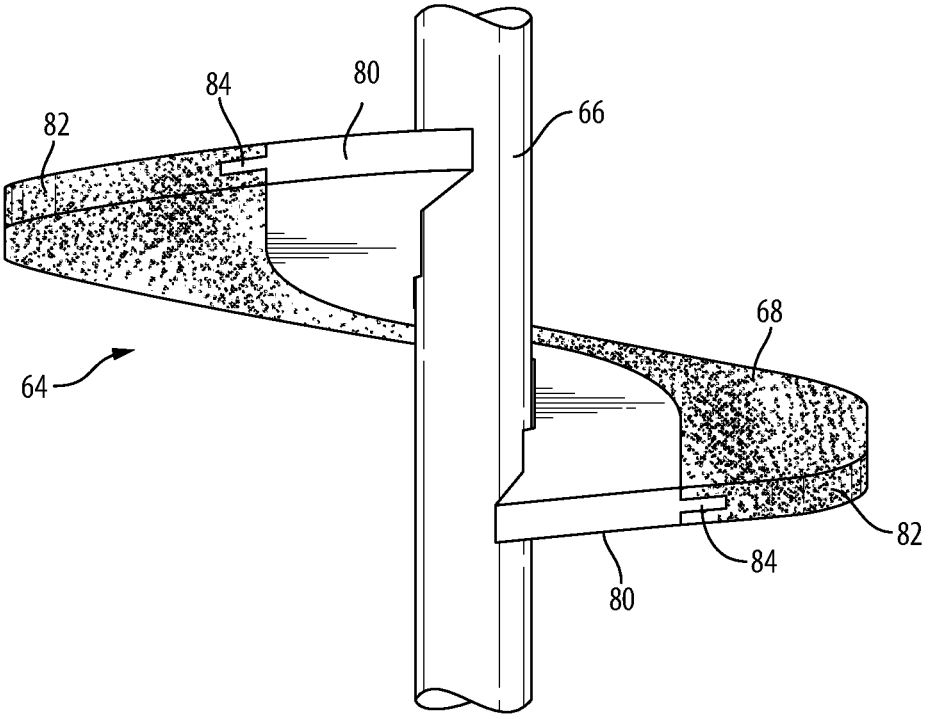

As noted above, according to illustrative embodiments of the present disclosure, helical plate(s) 68 may be made entirely from polymer composite materials or from polymer composite materials and metal. For example, as shown in FIG. 2G, shaft, tube or rod 66 may be made from a solid or hollow section of metal and may include one or more helical plates 68. According to an illustrative embodiment, helical plate 68 may include three distinct areas. The outer circumference areas 82 are formed from the polymer composite material and the inner circumference areas 80 are formed from metal. Metal inner circumference areas 80 include a relatively thin metal plate 84 extending from at least a portion of an outer periphery thereof to provide an attachment surface for the polymer composite material forming the outer circumference areas 82. The metal plate 84 may extend entirely or partially to the exterior edge of outer circumference areas 82. The metal plate 84 may include imperfections such as holes, indentations, grooves, etc. along its surface, allowing the polymer composite material to embed in the imperfections and provide a more positive grip on the metal plate 84. Areas of the metal inner circumference 80 may be welded to or otherwise joined to shaft, tube or rod 66 utilizing screws, rivets, etc. or other mechanical fasteners. The entire helical tip 64 may itself be encased in polymer composite material thus protecting the metal elements from the environment.

Figure 11:
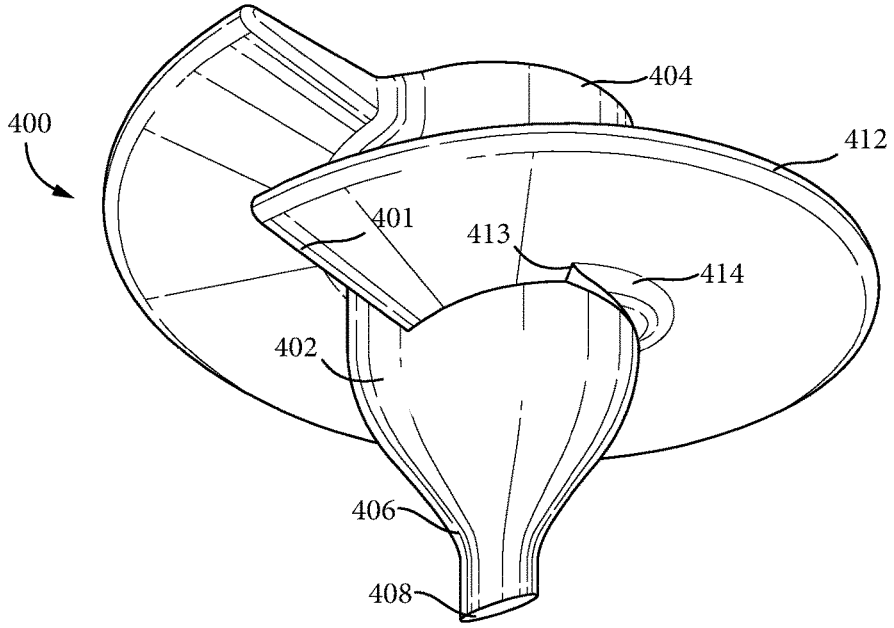
Figure 12:
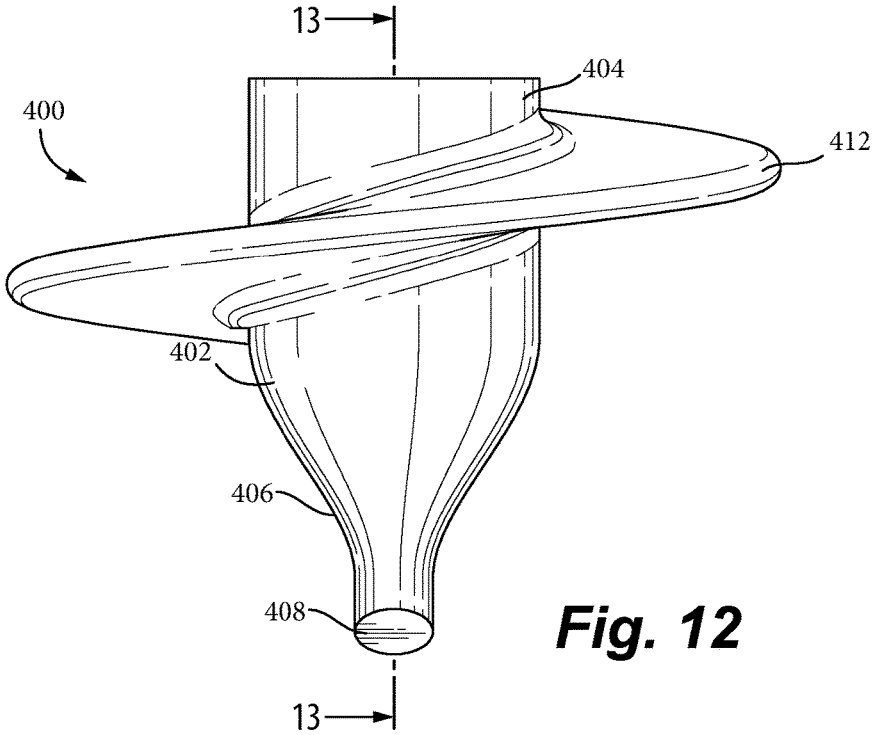
FIG. 12 is a side view of the helical anchor or tip of FIGS. 10 and 11 according to an illustrative embodiment of the present disclosure.
Figure 13:
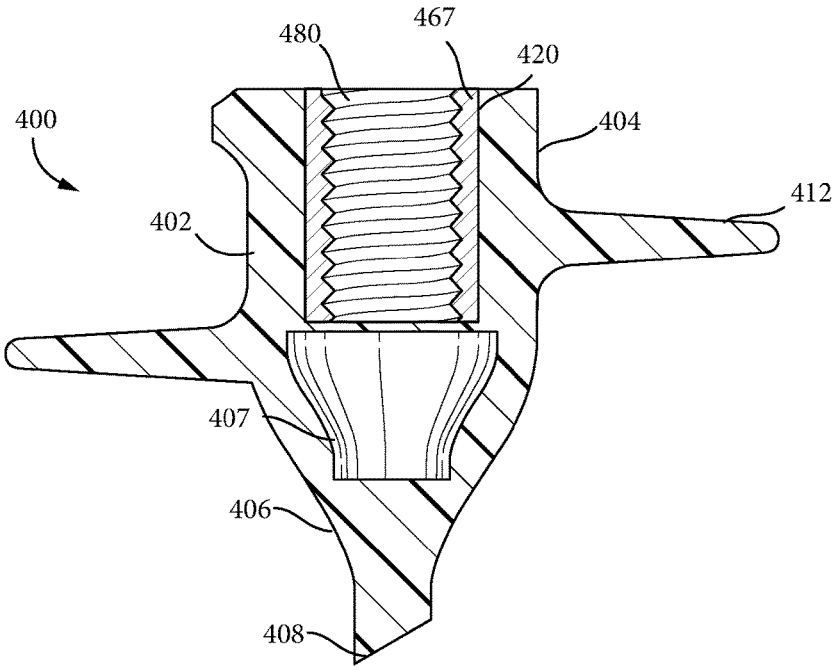
FIG. 13 is a cross-sectional view of the helical anchor or tip of FIG. 12 taken along lines 13-13.

According to the embodiments depicted in FIGS. 2D-2H, shaft 66 may be substantially square, rectangular, etc. However, according to other embodiments, the shaft forming a portion of the helical anchor or tip may be substantially round in lateral cross-section. For example, a helical anchor or tip 400 according to another illustrative embodiment is shown in FIGS. 10-13. Helical anchor or tip 400 may be formed entirely from composite materials such as, for example, polymer composite materials. Helical anchor or tip 400 includes a center section 402 which is substantially circular or round in lateral cross-section. Center section 402 includes an upper portion 404, a middle portion 406 and a lower portion 408. Upper portion 404 may have a substantially constant diameter to which helical plate 412 is attached or formed in situ with during the manufacturing process. Alternatively, upper portion 404 may taper slightly towards middle portion 406. Middle portion 406 has a funnel-like shape tapering down in diameter to lower portion 408. The distal end 410 of lower portion 408 is at an angle as shown for cutting into the soil during use. As noted above, helical plate 412 may be formed in situ with center section 402 and may include an upper fillet 416 along at least a portion of the upper edge of the helical plate 412 where it meets center section 402. A lower fillet 414 may be provided along at least a portion of the lower inside edge of the helical plate 412 where it meets center section 402. As shown in FIG. 11, the lower fillet 414 does not extend to the leading edge 401 of the helical plate 412 and includes a tapered leading edge 413. This results in less resistance when the helical plate is screwed into the earth during installation and minimizes damage to the fillet during the installation process. The upper end 418 of center section 402 may include a bore 420 which allows a tool to be used to apply torque when the anchor or tip 400 is rotated into the earth. Bore 420 may be round and may include female threads for receiving, for example, the threaded male connecting end 54 of shaft or lead 52 (or threaded end 62 of insert 58). Alternatively, according to the present illustrative embodiment, bore 420 is in a shape other than round and in this embodiment is square in cross-section (e.g., see FIG. 10). As shown in FIG. 13, a metal insert 467 having an outside shape which is non-circular in cross-section and in this embodiment is square is embedded in the bore 420 in the composite material forming the helical anchor or tip 400. Metal insert 467 includes a female bore 480 having inside threads and is dimensioned to receive, for example, the threaded male connecting end 54 of shaft or lead 52 (or threaded end 62 of insert 58). The non-round shape of the outer portion of metal insert 467 helps secure the insert 467 within the composite material allowing torque to be applied to anchor or tip 400 and aids in preventing rotation of the insert 467 within the composite material providing a more secure connection between the insert 467 and the rest of the helical anchor or tip 400.

As further shown in FIG. 13, a cavity 407 may be formed in a center portion of helical anchor or tip 400 reducing the weight of the helical anchor or tip 400 and reducing the amount of composite material required to form the helical anchor or tip 400. If desired, the cavity 407 may be filled partially or entirely with an insert such as, for example, a metal insert to increase the weight of the helical anchor or tip 400 while still reducing the amount of composite material required to form the helical anchor or tip 400. Alternatively, metal insert 467 may extend down into cavity 407 and be encased within the composite material.

Figure 2H:
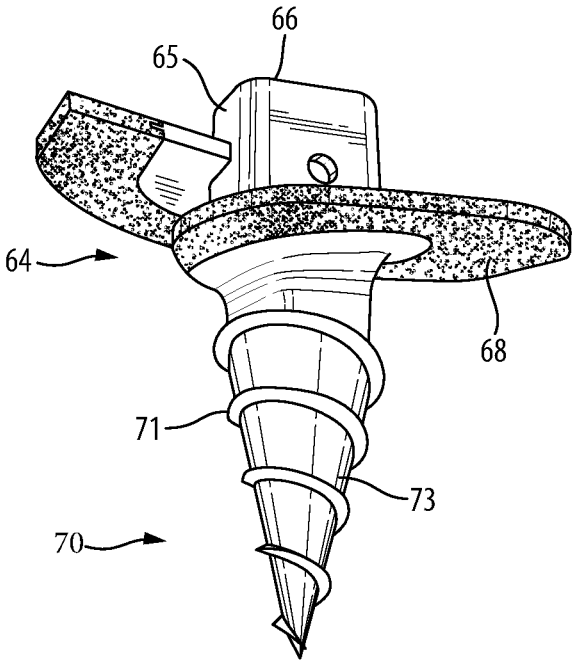

A variety of differently configured helical anchors or tips 64, 400 may be provided. For example, the diameter, thickness, shape and/or number of helical plates 18, 68, 412 may vary as required for a particular application. The size and shape of shaft, tube or rod 12, 66, 402 may also vary depending on a particular application (e.g., see FIGS. 3A-3E). According to an illustrative embodiment of the present disclosure as depicted in FIG. 2H, the pointed second end 70 may have a tapered tip 73 with or without screw-like threads 71 that screw into the ground. This allows the end user to select an appropriate helical anchor or tip 64, 400 depending on work site conditions including, for example, soil conditions, strength of hold required, amount of uplift resistance required, etc.

Figure 5:
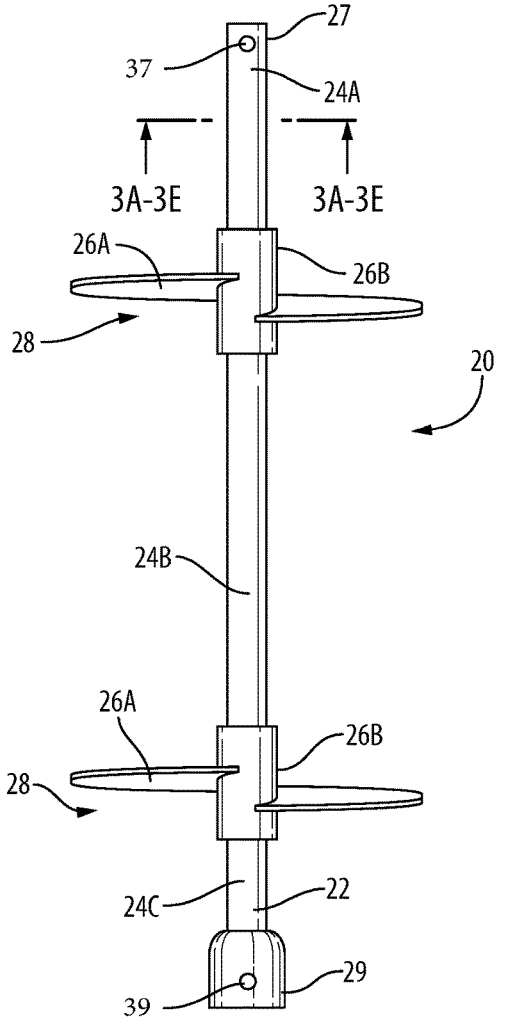
FIG. 5 is a side view of a helical anchor/pile according to another illustrative embodiment of the present disclosure.

A helical anchor/pile according to another illustrative embodiment of the present disclosure is depicted in FIG. 5 and is referred to herein as helical anchor/pile 20. Portions of helical anchor/pile 20 may be formed from polymer composite materials and portions may be formed from metal. For example, according to the present illustrative embodiment, shaft or lead portions 24A, 24B and 24C are made from one or more polymer composite materials. One or more helical plate units 28 are provided. Depending on a particular embodiment, helical plate unit 28 may be made entirely from polymer composite materials, metal or a combination thereof, similar to that described above with respect to other embodiments. It will be appreciated that any suitable number of helical plate units 28 may be provided depending on a particular application. Helical plate unit 28 includes a helical plate 26A and a shaft or lead portion 26B. If metal is utilized in the helical plate 26A (similar to the embodiment described above with respect to FIG. 2G), it may be welded to or otherwise joined to the metal shaft or lead portion 26B utilizing screws, rivets, etc. or other mechanical fasteners. According to an illustrative embodiment, shaft or lead portion 26B may have a hollow inner core. During the manufacturing process, one or more helical plate units 28 may be positioned within an appropriate mold and the polymer composite materials introduced to the mold such that the polymer composite materials extend through the hollow inner core(s) of lead portion(s) 26B resulting in the helical anchor/pile 20 depicted in FIG. 5. To ensure the cured polymer composite materials extending through the hollow inner core of shaft or lead portion 26B, do not break free and allow the composite shaft to rotate with respect thereto, the hollow inner core may be formed in a non-circular shape that would prevent such rotation. For example, the cross section of the hollow inner core of lead portion 26B may be square (FIG. 3A), rectangular (FIG. 3B), oblong (FIG. 3C), triangular (FIG. 3D), etc. such that when the polymer composite materials fill the hollow inner core, the helical plate unit 28 will not be able to rotate with respect to the shaft or lead portions 24A, 24B, 24C. Of course, the remaining portions of the shaft or lead portions 24A, 24B, 24C themselves may be formed in any desired cross-sectional shape as desired or one or more of the shaft or lead portions 24A, 24B, 24C may be formed in a different cross-sectional shape than the others. End 29 of helical anchor/pile 20 may have a pointed lead tip (17 as depicted in FIG. 1) or may be a female receptacle having an orifice 39 extending therethrough as shown. End 27 may be a male connection having an orifice 37 extending therethrough. Alternatively, ends 27, 29 may be threaded (male or female) or may consist of threaded male insert(s) 58 as shown in FIG. 2B and/or threaded female insert(s) 55 as shown in FIG. 2C. Ends 27, 29 may be formed from the polymer composite materials during the manufacturing process or may be metal inserts added during the manufacturing process. According to an illustrative embodiment of the present disclosure, during the manufacturing process, the mold may be arranged such that some or all of the metal parts are themselves encased in the polymer composite materials, to protect the metal components from the elements.

Figure 6:
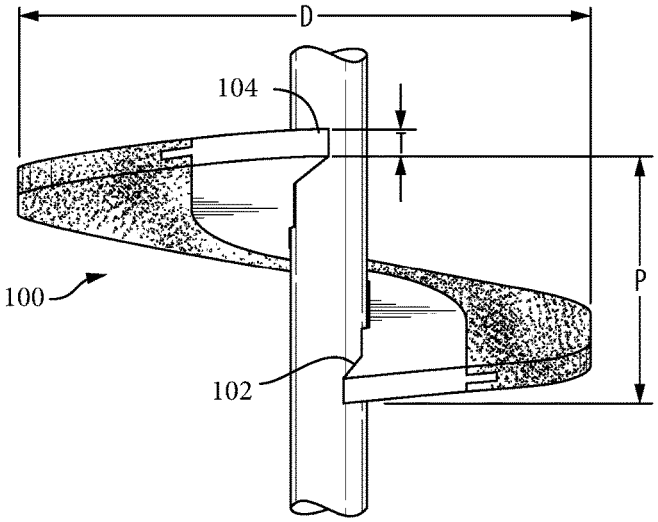
FIG. 6 is a side view of a helical plate according to an illustrative embodiment of the present disclosure.

According to illustrative embodiments of the present disclosure, the dimensions of the helical plates described herein may vary depending on several factors including, for example, the load the anchor/pile is to carry, the amount of uplift resistance required, the soil conditions into which the anchor/pile is to be set and/or the type of equipment used for installation. Referring to FIG. 6, the diameter "D" of the helical plate 100 may range from between about 6 inches and about 16 inches depending upon the particular application. For example, for helical anchors, the diameter of the helical plate 100 may range from about 8-14 inches. The thickness "T" of the helical plate 100 may also vary depending on a particular application. For helical anchors, the thickness "T" may range from one quarter inch to a half inch. The pitch "P" of the helical plate 100 may generally be between 1 inch and 4 inches. Helical plate 100 has a leading edge 102 and a trailing edge 104.

Figure 7A:
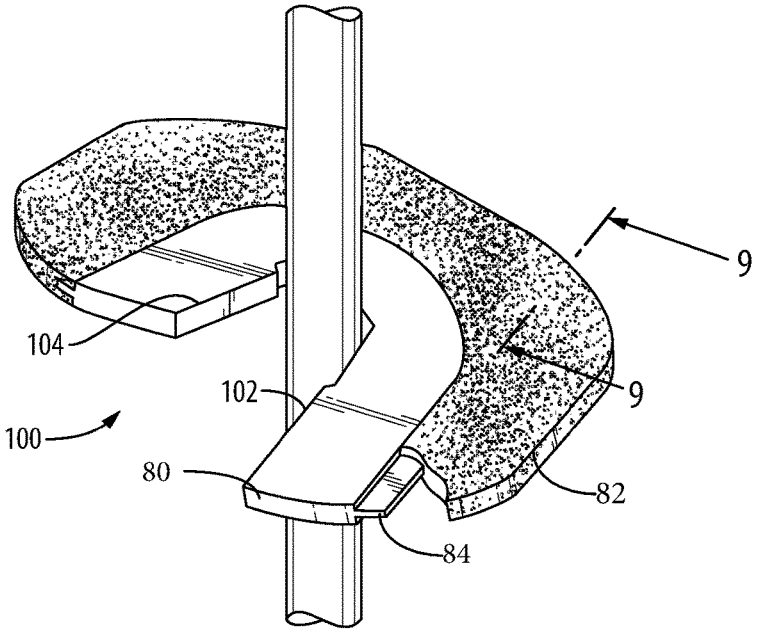
FIGS. 7A-7C are top and side views of helical plates according to illustrative embodiments of the present disclosure.
Figure 7B:
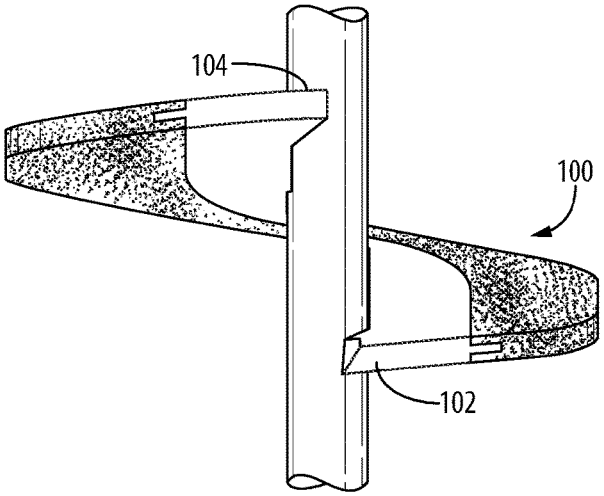
Figure 7C:
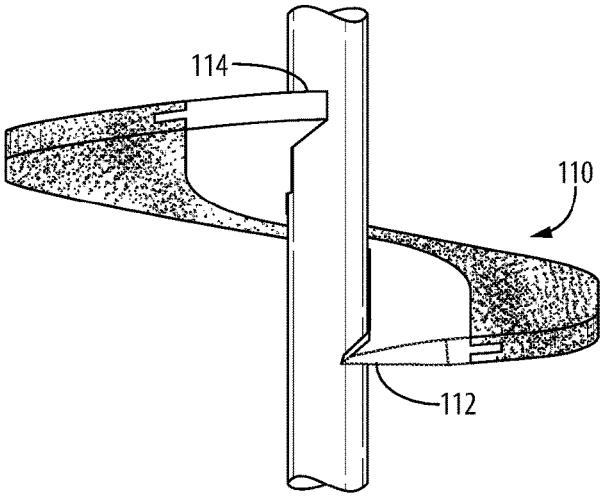

The helical plates described herein may be formed in any desired shape suitable for a particular application. For example, as depicted in FIGS. 7A, 7B, a helical plate 100 may have a tapered shape which is narrower (e.g., has a smaller diameter) at its leading edge 102 than at its trailing edge 104, with the leading edge 102 being the edge which first enters the ground when the helical plate 100 is screwed into the ground. In addition, according to an illustrative embodiment of the present disclosure as shown in FIG. 7C, the leading edge 112 and/or outermost edges of the helical plates described herein may be tapered providing more of a knife-like cutting edge for slicing into the ground when the helical anchor/pile is screwed into the ground. Helical plate 110 has a trailing edge 114.

Figure 9:
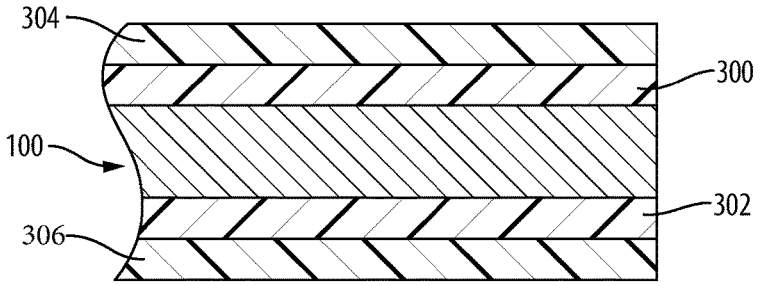
FIG. 9 is a cross-sectional view of a portion of a helical plate depicted in FIG. 7A according to an illustrative embodiment of the present disclosure.
Figure 10:
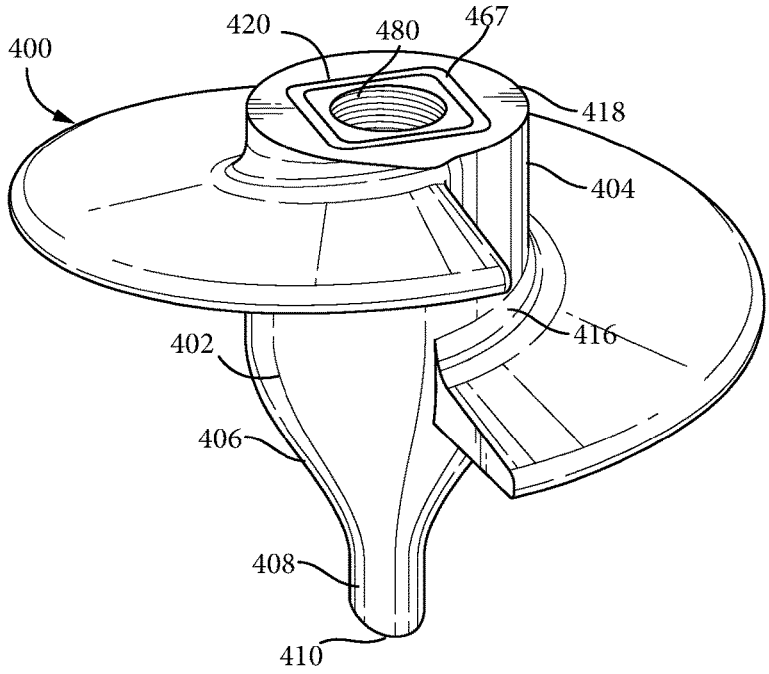
FIGS. 10 and 11 are perspective views of a helical anchor or tip according to an illustrative embodiment of the present disclosure.

According to an illustrative embodiment of the present disclosure, the polymer composite materials and reinforcing materials may include polymer-impregnated fiber strands which may be layered to form the helical plates depicted herein. The fiber strands may be glass, carbon, basalt, aramid or combinations thereof. FIG. 9 is a cross-sectional view of a portion of a helical plate 100 such as that depicted in FIG. 7A. According to this embodiment, one or more outer layers of polymer-impregnated fiber strands 304, 306 are layered in a direction following the shape of the helix from leading edge 102 to trailing edge 104 (see FIG. 7A). One or more layers of polymer-impregnated glass fiber strands 300, 302 may also be placed obliquely to the fiber strands 304, 306 to provide additional strength and rigidity. The glass fiber strands at the leading edge 102 may be rounded over and/or tapered such that when the helical anchor/pile is screwed into the ground, the fiber layers are less likely to separate and delaminate. The polymer-impregnated fiber strands may also be in the form of a mat of interwoven fiber strands. Abrasion resistant materials (Alumina Trihydrate, Titanium dioxide, Calcium Carbonate, etc) may be added to the polymer- to further protect the helical plates during installation into the ground.

Figure 8:
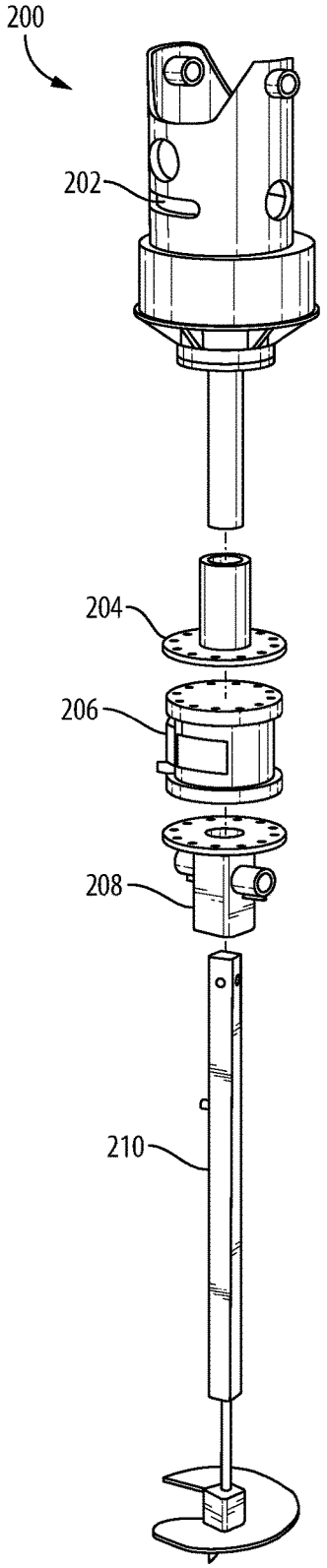
FIG. 8 is a perspective view of a system for driving helical anchors/piles into the ground according to various embodiments of the present disclosure.

Helical anchors/piles such as those described herein are installed by applying downward pressure and rotational torque to the shaft at the lead head portion that causes the helical plates to rotate and screw into the soil with minimal disruption to the surrounding soil. As the lead penetrates the soil, one or more extensions may be added to the anchor/pile so that the anchor/pile can achieve the desired depth. An example of a system 200 that may be used to install helical anchors/piles is depicted in FIG. 8 and includes a digger motor 202, a kelly bar 204, torque indicator 206, a locking dog 208 and a drive wrench 210. Digger motor 202 is oriented in a downward direction and applies rotational force to the helical anchor/pile thus screwing the helical anchor/pile into the ground. The amount of torque being applied may be monitored utilizing the torque indicator 206 so that the maximum amount of torque the helical anchor/pile can handle is not exceeded and to identify the holding strength of the ground which the helical anchor/pile has reached.

The helical anchors/piles, leads, shafts, extensions, anchor rods, etc. described herein provide solutions and advantages to the metal helical anchors/piles presently in use in terms of ease of manufacture, ease of use, weight, environmental impact, corrosion resistance, etc. The particular configuration of anchors/piles, leads, shafts, extensions, anchor rods, etc. used as well as the shapes and diameters of the helical plates will depend upon the load the anchors/piles are to bear, the amount of uplift resistance required and the soil conditions. However, it will be understood that various modifications can be made to the embodiments of the present disclosure herein without departing from the spirit and scope thereof. Therefore, the above description should not be construed as limiting the disclosure, but merely as illustrative embodiments thereof. Those skilled in the art will envision other modifications within the spirit and scope of the present disclosure and as defined by the claims appended hereto.

What is claimed is:

1. A helical anchor/pile comprising:

a polymer composite shaft having an end portion and a head portion, wherein the head portion is configured to connect to at least one of an extension and a thimble eyelet; and at least one helical plate attached at the end portion of the shaft, wherein the at least one helical plate is formed from at least one of a polymer composite material and metal, the at least one helical plate comprising a metal inner circumferential helical plate and a polymer composite outer circumferential helical plate, and wherein the polymer composite outer circumferential helical plate extends over at least a portion of the metal inner circumferential helical plate.

2. The helical anchor/pile according to claim 1, further comprising polymer-impregnated fiber strands covering at least one surface of the helical plate.

3. The helical anchor/pile according to claim 2, wherein the helical plate is in a shape of a helix and at least one first layer of polymer-impregnated fiber strands extend in a direction of the helix from a leading edge of the helical plate to a trailing edge of the helical plate.

4. The helical anchor/pile according to claim 3, further comprising at least one second layer of polymer-impregnated fiber strands extending obliquely to the first layer of polymer-impregnated fiber strands.

5. The helical anchor/pile according to claim 2, wherein the polymer-impregnated fiber strands comprise at least one of glass, carbon, basalt and aramid.

6. The helical anchor/pile according to claim 2, wherein the polymer composite and/or polymer-impregnated fiber strands comprise at least one of a thermosetting resin including, for example, polyester, vinyl ester and epoxy resin and the like and a thermoplastic including, for example, PP, PE, PET, TPU, PA6, PA66, POM, PEEK, PAEK, PPS and the like or combinations thereof.

7. The helical anchor/pile according to claim 1, wherein a cross-sectional shape of the polymer composite shaft is at least one of square, rectangular, oblong, rectangular and round.

8. A helical anchor/pile comprising:

a polymer composite shaft having an end portion and a head portion, wherein the head portion is configured to connect to at least one of an extension and a thimble eyelet; and at least one helical plate attached at the end portion of the shaft, and further comprising polymer-impregnated fiber strands covering at least one surface of the helical plate, wherein the polymer-impregnated fiber strands comprise an interwoven mat of fiber strands.

* * * * *